US010782636B2

(12) United States Patent
Sato

(10) Patent No.: US 10,782,636 B2
(45) Date of Patent: Sep. 22, 2020

(54) TEMPERATURE CONTROL OF HEATER IN IMAGE FORMING APPARATUS

(71) Applicant: CANON KABUSHIKI KAISHA, Tokyo (JP)

(72) Inventor: Tomoharu Sato, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/737,224

(22) Filed: Jan. 8, 2020

(65) Prior Publication Data

US 2020/0233344 A1 Jul. 23, 2020

(30) Foreign Application Priority Data

Jan. 18, 2019 (JP) ..... 2019-007173

(51) Int. Cl.
*G03G 15/20* (2006.01)
*G03G 15/00* (2006.01)

(52) U.S. Cl.
CPC ..... *G03G 15/2039* (2013.01); *G03G 15/2053* (2013.01); *G03G 15/80* (2013.01)

(58) Field of Classification Search
CPC ..... G03G 15/2039; G03G 15/205; G03G 15/2053; G03G 15/80
See application file for complete search history.

(56) References Cited

U.S. PATENT DOCUMENTS

2012/0321334 A1* 12/2012 Asano ..... G03G 15/205 399/69
2015/0093134 A1* 4/2015 Itoh ..... G03G 15/2039 399/67

FOREIGN PATENT DOCUMENTS

JP 2017026858 A 2/2017

* cited by examiner

*Primary Examiner* — Hoang X Ngo
(74) *Attorney, Agent, or Firm* — Rossi, Kimms & McDowell LLP

(57) ABSTRACT

An apparatus decides a supply rate for each control period that comprises a plurality of half periods in an alternating current based on a difference between a target temperature and a temperature detected by a detector. In a case where the same supply rate over a plurality of the control period is decided, a start phase angle that is a reference for a supply start corresponding to the supply rate is decided so that the start phase angle is located outside a prohibited section and a combination of the start phase angle differs for each control period. For each of a plurality of half periods configuring the control period, supply of the alternating current to a heater is started at the start phase angle. When a zero cross point of the alternating current arrives, the supply of the alternating current is stopped.

18 Claims, 8 Drawing Sheets

TEMPERATURE CONTROL OF HEATER IN IMAGE FORMING APPARATUS

BACKGROUND OF THE INVENTION

Field of the Invention

The present invention relates to temperature control of a heater in an image forming apparatus.

Description of the Related Art

An image forming apparatus employing an electrophotographic process or an electrostatic printing process applies heat to a toner image to fix the toner image to a sheet. A fixing device performs so-called phase control in which the temperature of the fixing device is maintained at a target temperature by controlling the amount of alternating current to be supplied every half wave. In the phase control, a start phase angle at which supply of current is started is decided so that a difference between a target temperature and a measured temperature becomes small, and an alternating current is supplied to the heater during the period from the start phase angle to an end phase angle (Japanese Patent Laid-Open No. 2017-26858).

In Japanese Patent Laid-Open No. 2017-26858, it is proposed to reduce a harmonic current by providing a prohibited section in which a start phase angle cannot be set in a half period of an alternating current. In addition, in Japanese Patent Laid-Open No. 2017-26858, it is proposed to prevent a steep rise in a total amount of current supply of two heaters by shifting start phase angles of the two heaters.

In the prior art, there may be a case in which the harmonic current cannot be sufficiently reduced because the prohibited section, which is a range of phases in which an electrical connection start cannot be set in phase control, is fixed. In particular, as the range of basis weights of commercially available print materials has widened, higher output heaters have become necessary. If low power is continuously supplied to a high output heater for a low basis weight print material, a start phase angle at which a harmonic current is apt to be generated is used consecutively. This can occur, for example, in the case where a heater of 1000 W (100% supply rate) class is continuously used at 500 W (50% supply rate). If the prohibited section is widened in order to reduce the harmonic current, the temperature followability of the heater is lowered.

SUMMARY OF THE INVENTION

The present invention provides an image forming apparatus comprising the following elements. A fixing unit has a heater and is configured to fix a toner image to a sheet by applying heat from the heater. A temperature detector configured to detect a temperature of the fixing unit. A controller controls a supply of alternating current to the heater. The controller decides a supply rate for each control period that comprises a plurality of half periods in the alternating current, based on a difference between a target temperature of the fixing unit and the temperature detected by the temperature detector. In a case where the same supply rate over a plurality of the control period is decided, the controller decides a start phase angle that is a reference for a supply start corresponding to the supply rate so that the start phase angle is located outside a prohibited section and a combination of the start phase angle differs for each control period. For each of a plurality of half periods configuring the control period, the controller starts supply of the alternating current to the heater at the start phase angle, and stops supply of the alternating current to the heater when a zero cross point of the alternating current arrives.

Further features of the present invention will become apparent from the following description of exemplary embodiments (with reference to the attached drawings).

DESCRIPTION OF THE EMBODIMENTS

Figure 1:
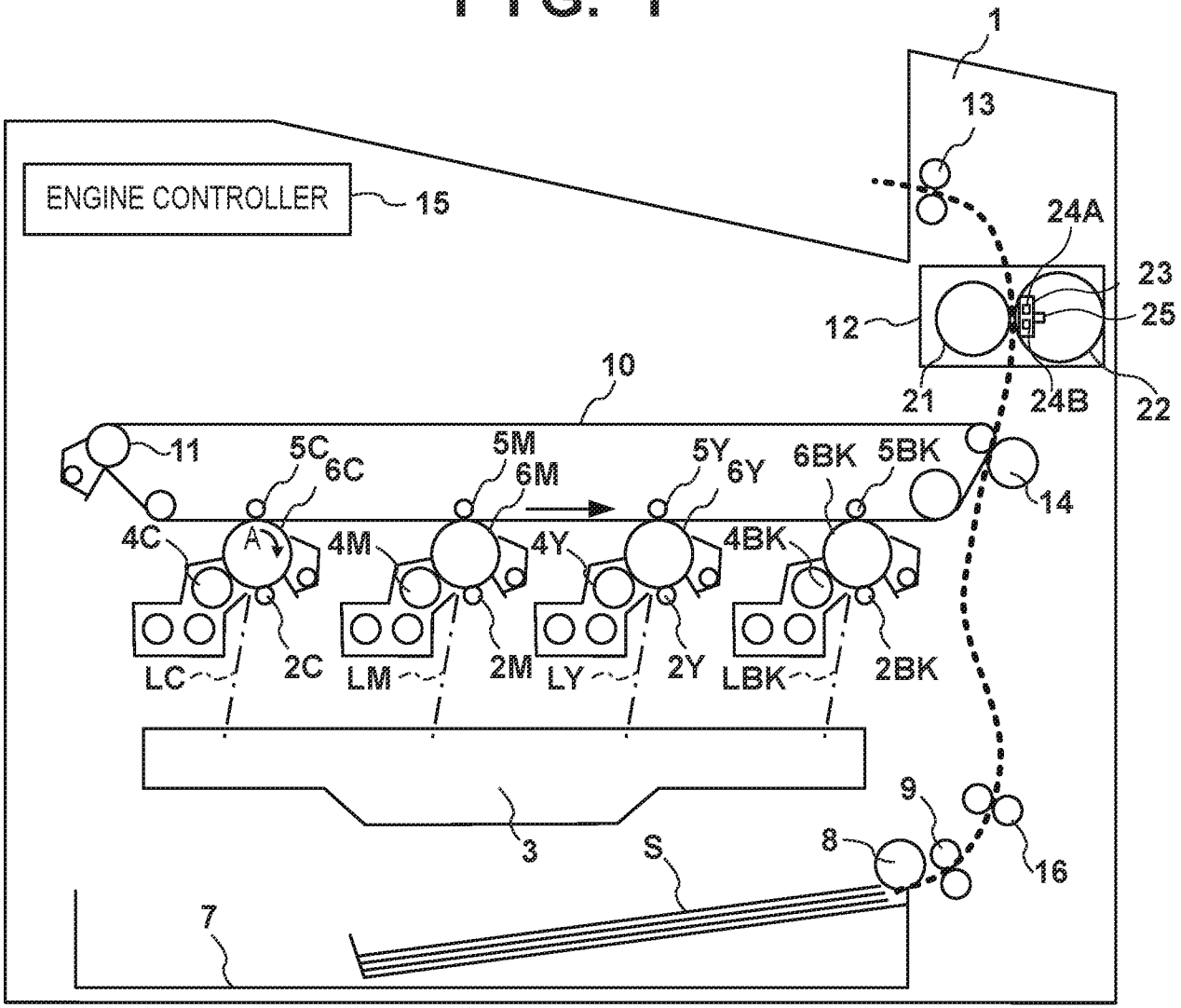
FIG. 1 is a view for describing an image forming apparatus.

Hereinafter, embodiments will be described in detail with reference to the accompanying drawings. Note that the following embodiments do not limit the invention according to the scope of the appended claims. Although a plurality of features are described in the embodiments, not all of the plurality of features are essential to the present invention, and the plurality of features may be arbitrarily combined. In addition, in the accompanying drawings, the same reference numerals are assigned to the same or similar components, and duplicate descriptions are omitted.

[Image Forming Apparatus]

FIG. 1 illustrates an intermediate transfer type image forming apparatus 1. The image forming apparatus 1 may be an image forming apparatus that forms a single-color image, but here, it is an electrophotographic image forming apparatus that forms a multicolor image by mixing a plurality of colorants. The image forming apparatus 1 uses developers of four colors, such as yellow (Y), magenta (M), cyan (C), and black (BK). In FIG. 1, a character indicating a color is given to the end of a reference number, but this character is omitted when a matter common to four colors is described.

Photosensitive drums 6C, 6M, 6Y, and 6BK are arranged at equal intervals, and are image carriers for carrying electrostatic latent images and toner images. A primary charger 2 is an example of a charging unit for uniformly charging the image carrier. The primary charger 2 uniformly charges the surface of a photosensitive drum 6 by using a charging voltage. A scanning optical device 3 is an example of a scanning unit that forms an electrostatic latent image by scanning the surface of an image carrier with laser light. The scanning optical device 3 emits a luminous flux (a laser beam) L modulated based on an input image toward the photosensitive drum 6. The luminous flux L forms an electrostatic latent image on the surface of the photosensitive drum 6. A developing device 4 causes cyan, magenta, yellow, or black developer to adhere to the electrostatic latent image through a sleeve or blade to which a developing voltage is applied, respectively. As a result, the electrostatic latent image is developed, and a developer image (a toner image) is formed.

A feeding roller 8 feeds the sheets S accommodated in the feeding tray 7 one by one. A separation roller 9 separates one sheet S from the plurality of sheets S fed by the feeding roller 8, and feeds the sheet S to the conveying path. A conveying roller 16 feeds the sheet S toward a secondary transfer portion in synchronization with an image write start timing.

A primary transfer roller 5 transfers the toner image carried on the photosensitive drum 6 to an intermediate transfer belt 10. A primary transfer voltage is applied to the primary transfer roller 5 to transfer the toner image onto the intermediate transfer belt 10. The intermediate transfer belt 10 functions as an intermediate transfer member. A driving roller 11 is a roller for rotating the intermediate transfer belt 10. The secondary transfer portion has a secondary transfer roller 14. In the secondary transfer portion, the intermediate transfer belt 10 and the secondary transfer roller 14 convey the sheet S while sandwiching the sheet S therebetween, whereby a multi-color toner image carried on the intermediate transfer belt 10 is transferred onto the sheet S. The secondary transfer voltage facilitates transfer of the toner image to the sheet S. Thereafter, the sheet S is conveyed to a fixing device 12. The fixing device 12 applies pressure and heat to the toner image carried on the sheet S to fix it. A discharge roller 13 discharges the sheet S on which the image has been formed. Note that, the primary transfer roller 5, the intermediate transfer belt 10, and the secondary transfer roller 14 are examples of a transfer unit for transferring a toner image onto a sheet. The fixing device 12 is an example of a fixing unit for fixing a toner image carried on a sheet.

The fixing device 12 has a pressure roller 21 and a fixing belt 22. A ceramic heater 23 for heating the toner image is provided inside the fixing belt 22. The ceramic heater 23 has a first heater 24A and a second heater 24B whose longitudinal directions are the rotation axis of the fixing belt 22. The first heater 24A and the second heater 24B are arranged side by side in parallel, and have different heat generation distributions in the longitudinal direction. A controller 15 measures the temperature of the ceramic heater 23 using a thermistor 25 as a temperature detector, and controls the amount of power to be supplied to the ceramic heater 23 according to the difference between the measured temperature and a target temperature. Note that, by using a plurality of heaters having different heat generation distributions such as the first heater 24A and the second heater 24B, temperature unevenness of the ceramic heater 23 is reduced.

<Concept of Phase Control>

Figure 2A:
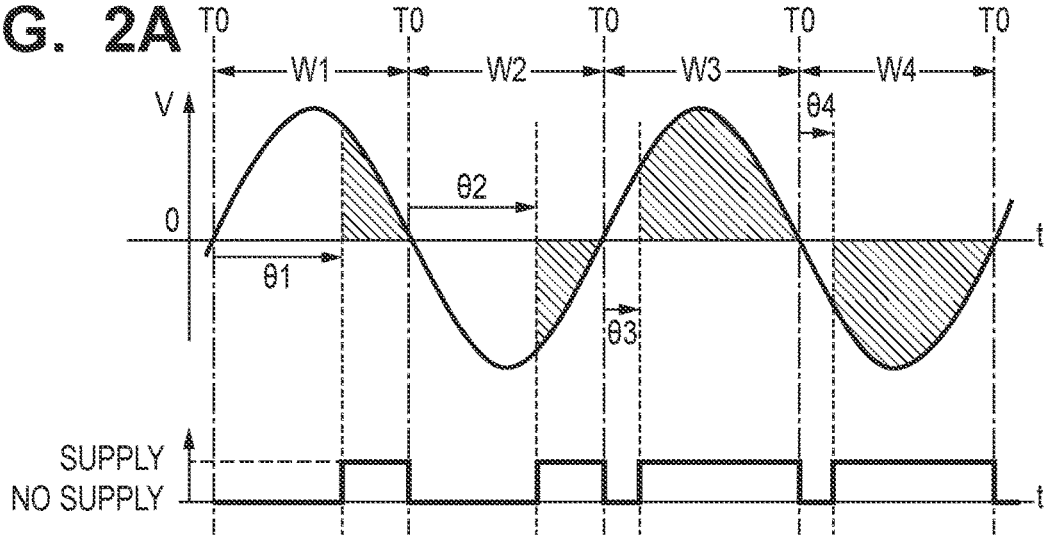
FIGS. 2A to 2C are views for describing a method of reducing a harmonic current.

FIG. 2A is a diagram for describing phase control for an alternating current waveform. The horizontal axis represents time t. The vertical axis of the upper graph represents voltage V. The vertical axis of the lower graph represents the state of supply (on/off). The phase control is control of the power supplied to the heater by turning on the heater at an particular phase angle within one half wave of the alternating current waveform and turning off the heater at the next zero cross point T0. The zero cross point is a point at which the amplitude (voltage) of the alternating current waveform becomes 0 [V]. The phase angles corresponding to the zero cross points are, for example, 0 degrees (360 degrees) and 180 degrees. In this case, phase control is performed using four half waves W1, W2, W3, and W4 as a set. In other words, one control period corresponds to two periods of the alternating current waveform. The controller 15 decides a target temperature in accordance with sheet information (e.g.: basis weight) of the sheet S, and decides the amount of power supplied to the ceramic heater 23 for each control period so that the difference between the target temperature and the measured temperature becomes small. The sheet information is information used for deciding the fixing temperature, and is, for example, information that designates the size of the sheet P, the presence or absence of a coating, the basis weight, and simplex/duplex printing. As a control parameter for the heater, here, a concept of a supply rate, which is a parameter correlated with the amount of power, is introduced. The supply rate is a ratio of the amount of power actually supplied in one control period with respect to the maximum amount of power that can be supplied in one control period. The supply rate may be expressed as a percentage for convenience of description. The controller 15 decides the supply rate so that the difference between the target temperature and the measured temperature becomes small, and decides start phase angles θ1, θ2, θ3, and θ4 of the four half waves W1, W2, W3, and W4, respectively, so that the decided supply rate is achieved. According to the FIG. 2A, in the half wave W1 (the first half wave), supply is started at the start phase angle θ1, and supply ends at the next zero cross point T0. In the half wave W2 (the second half wave), supply is started at the start phase angle θ2, and supply ends at the next zero cross point T0. In the half wave W3 (the third half wave), supply is started at the start phase angle θ3, and supply ends at the next zero cross point T0. In the half wave W4 (the fourth half wave), supply is started at the start phase angle θ4, and supply ends at the next zero cross point T0. In other words, hatched portions in FIG. 2A and the like mean the supply regions. Incidentally, a triac may be used as an element for switching between supply of power and stoppage. Once the triac is turned on, it is not switched off until the input voltage becomes 0V. Therefore, the triac terminates the supply at the zero cross point T0.

For example, in a case where the start phase angle θ is set to 180 [degrees], the supply rate in the half wave W becomes 0 [%]. In a case where the start phase angle θ is set to 0 [degrees], the supply rate in the half wave W becomes 100 [%]. In a case where the start phase angle θ is set to 90 [degrees], the supply rate in the half wave W becomes 50 [%]. Also, in a case where one control period is configured by four half waves, the supply rate in one control period is the average value of the supply rates of the four half waves.

For example, it is assumed that the start phase angle θ1 of the first half wave W1 and the start phase angle θ2 of the second half wave W2 are set so that the supply rate becomes 30 [%]. It is assumed that the start phase angle θ3 of the third half wave W3 and the start phase angle θ4 of the fourth half wave W4 are set so that the supply rate becomes 70 [%]. In this case, the supply rate in one control period is 50 [%].

<Harmonic Current>

A harmonic current is a noise current generated by performing phase control on the ceramic heater 23. In phase control, harmonic currents are generated due to the following three factors.

First factor: when supply of the alternating current is started in the vicinity of the phase angles of 90 [degrees] or 270 [degrees], current change before and after supply becomes a maximum, and a harmonic current is generated.

Second factor: In a case where supply of the alternating current to a plurality of heaters is started at the same phase angle, current change over the entire fixing device becomes large, and a harmonic current is generated.

Third factor: If the supply is continued at the same phase angle over a plurality of control periods, a level of a harmonic current spectrum corresponding to the phase angle becomes high. Specifically, in a case where a high power heater is periodically supplied with low power (e.g.: supply rate=50[%]) in accordance with phase control, the average value of the harmonic current increases.

The harmonic current related to the first factor is reduced by setting the vicinity of the phase angle 90 [degrees] and the vicinity of 270 [degrees] to prohibited sections for a start phase angle. In addition, the harmonic current related to the second factor is reduced by making the start phase angles different so that power is supplied to the plurality of heaters at different timings. The harmonic current for the third factor is reduced by deciding the start phase angle such that the same combination of start phase angles does not continue over a plurality of control periods.

Figure 2B:
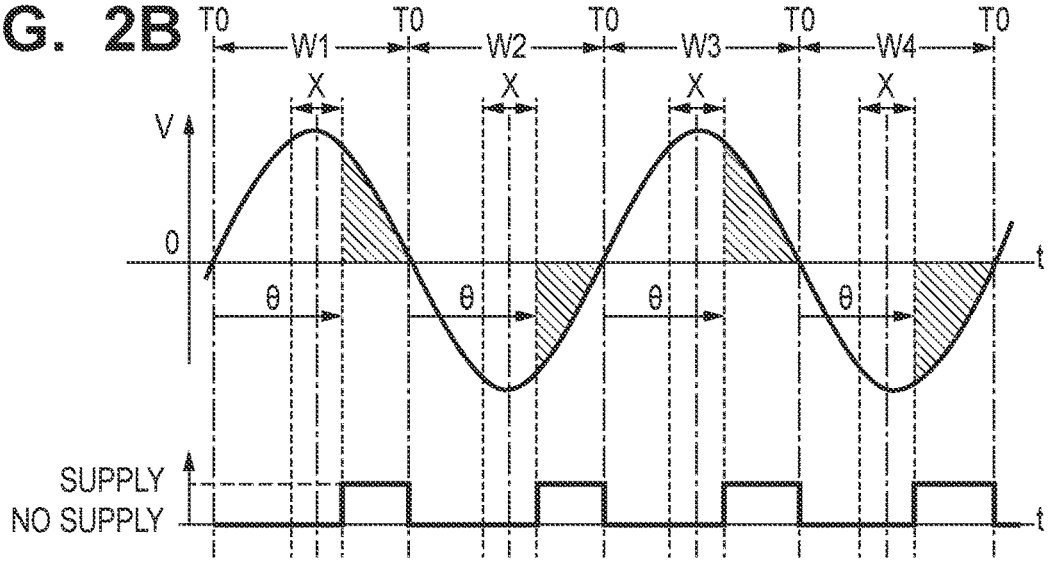

FIG. 2B illustrates that prohibited sections X are set in the vicinity of phase angles at which the amplitudes of the alternating currents are a maximum. The controller 15 sets prohibited sections X in the vicinity of phase angles at which the amplitude of the alternating current becomes a maximum. In this example, prohibited sections X that have a predetermined width are set so as to include 90 degrees, 270 degrees, 450 degrees, and 630 degrees, respectively. In particular, the start phase angle θ of the half waves W1 to W4 is set so as to coincide with the end of the prohibited section X. As a result, the harmonic current related to the first factor is reduced.

Figure 2C:
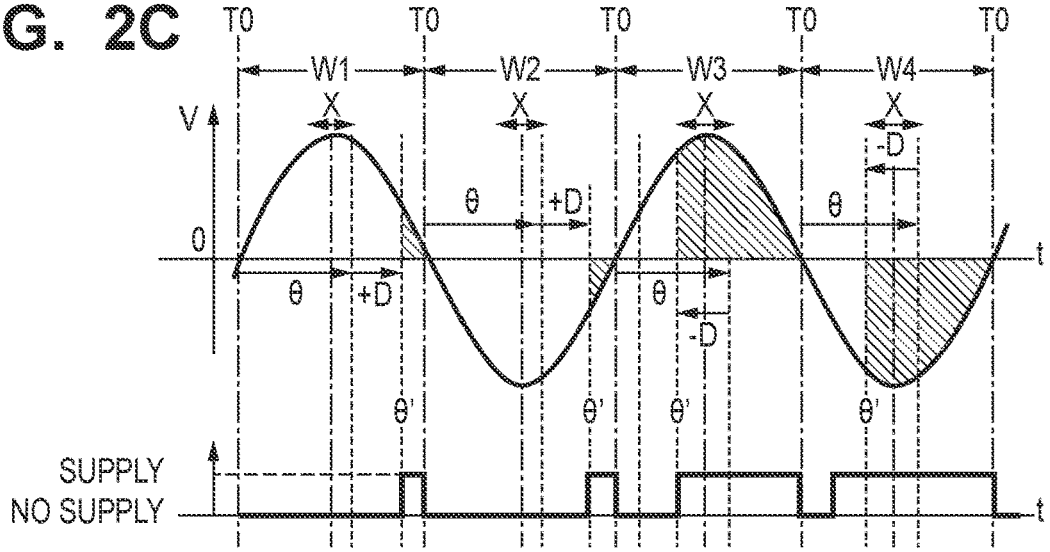

FIG. 2C illustrates a method of reducing harmonic currents associated with the first factor. The controller 15 corrects the start phase angle θ by a shift amount D so that the start phase angle θ decided in accordance with the supply rate is located outside the prohibited section X. Correction is performed by +D for the half waves W1 and W2. Correction is performed by −D for the half waves W3 and W4. The reason why the signs of the shift amounts of the half waves W1 and W2 and the half waves W3 and W4 are different from each other is to maintain the average supply rate in one control period as much as possible.

Figures 3A, 3B:
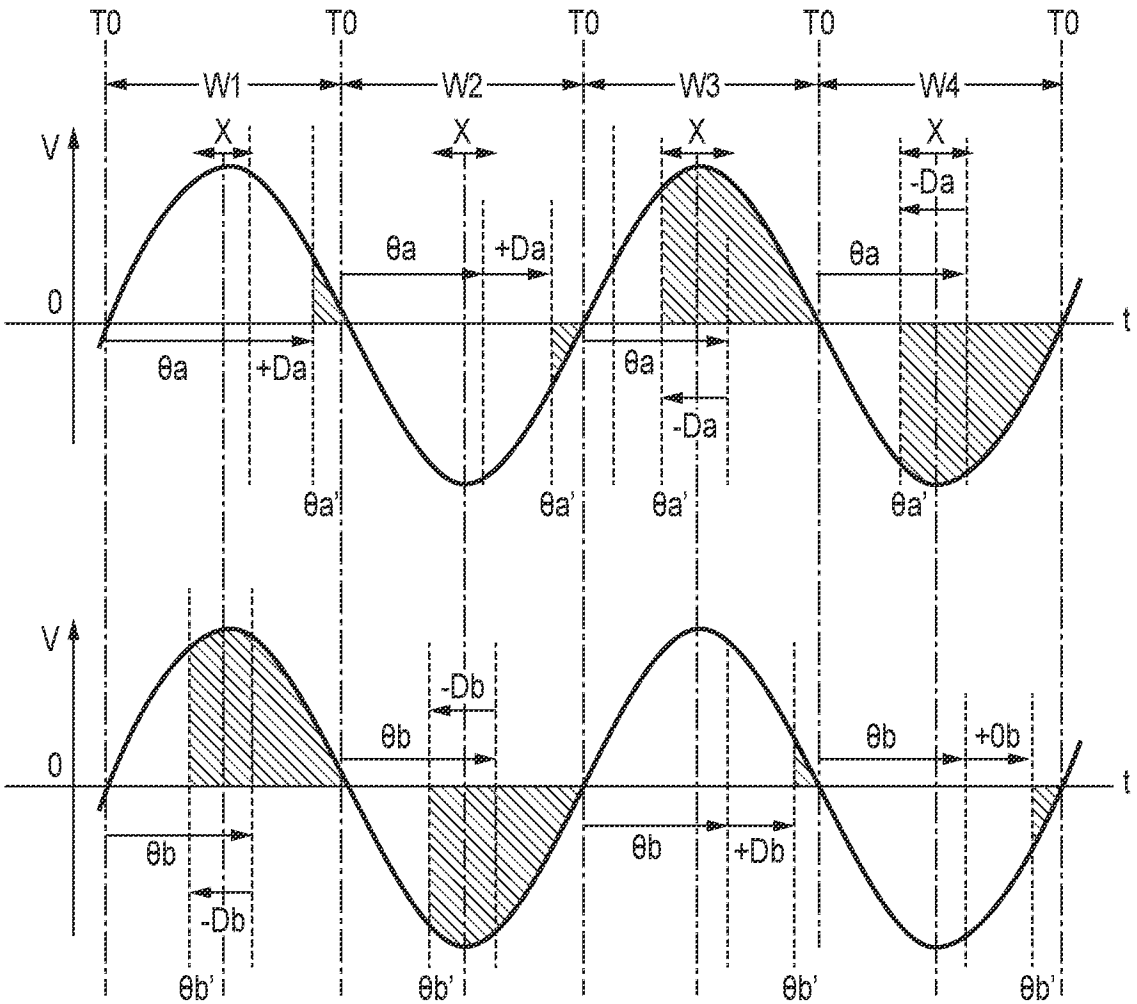
FIGS. 3A and 3B are views for describing a method of reducing a harmonic current.

FIG. 3A illustrates a method of reducing harmonic currents associated with the second factor for the first heater 24A. FIG. 3B illustrates a method of reducing harmonic currents associated with the second factor for the second heater 24B. The controller 15 decides the start phase angle θa of the first heater 24A and the start phase angle θb of the second heater 24B based on the supply rate. Further, the controller 15 sets prohibited sections X for the first heater 24A and the second heater 24B, respectively. Note that, in consideration of the first factor, the controller 15 decides the start phase angle such that the start phase angle corresponding to the supply rate is located outside the prohibited section X. For example, the controller 15 may decide shift amounts Da and Db based on the supply rates and the prohibited section X. For the half waves W1 and W2, the start phase angle θa' after correction of the first heater 24A is θa+Da, and the start phase angle after correction of the second heater 24B is θb−Db. For the half waves W3 and W4, the start phase angle θa' after correction of the first heater 24A is θa−Da, and the start phase angle after correction of the second heater 24B is θb+Db. In this manner, the distance between the start phase angle θa' and the start phase angle θb' is sufficiently secured, so that the harmonic current related to the second factor is reduced. Other methods can be used as long as the distance between the start phase angle θa' and the start phase angle θb' is sufficiently secured.

Figure 4A:
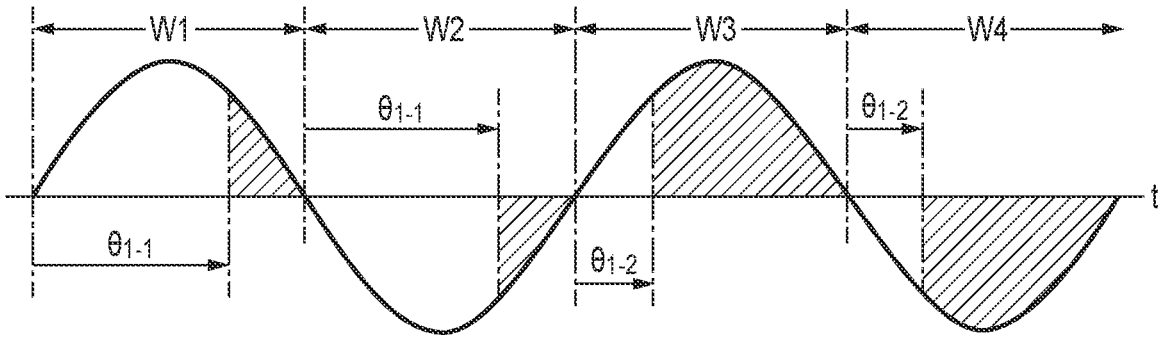
FIGS. 4A to 4C are views for describing a method of reducing a harmonic current.
Figure 4B:
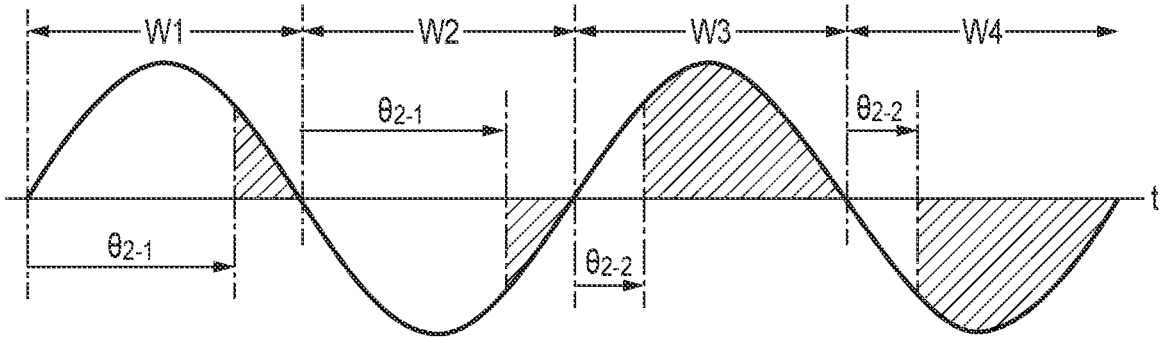
Figure 4C:
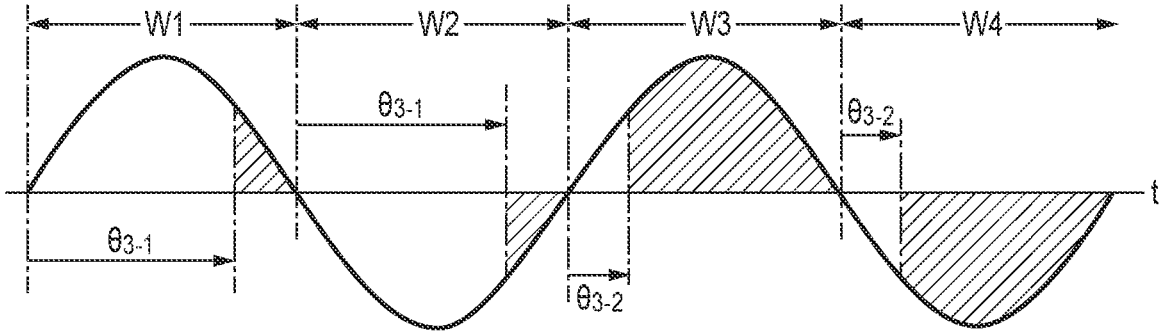

In order to describing the method of reducing the harmonic current by the third factor, FIGS. 4A to 4C are referred to. FIG. 4A illustrates a first control period, FIG. 4B illustrates a second control period which is a control period next to the first control period, and FIG. 4C illustrates a third control period which is a control period that follows the second control period. The first control period comprises a first period and a second period of the alternating current. The second control period comprises a third period and a fourth period of the alternating current. The third control period comprises a fifth period and a sixth period of the alternating current. Here, it is illustrated that a plurality of control periods each having a supply rate of 50% (corresponding to a start phase angle of) 90° are consecutive. In the first control period, the supply rate of the first half wave W1 and the supply rate of the second half wave W2 are 30% (start phase angle θ1-1), respectively, and the supply rate of the third half wave W3 and the supply rate of the fourth half wave W4 are 70% (start phase angle θ1-2), respectively. In the second control period, the supply rate of the first half wave W1 and the supply rate of the second half wave W2 are 25% (start phase angle θ2-1), respectively, and the supply rate of the third half wave W3 and the supply rate of the fourth half wave W4 are 75% (start phase angle θ2-2), respectively. In the third control period, the supply rate of the first half wave W1 and the supply rate of the second half wave W2 are 20% (start phase angle θ3-1), respectively, and the supply rate of the third half wave W3 and the supply rate of the fourth half wave W4 are 80% (start phase angle θ3-2), respectively. As described above, the combination of the start phase angle applied to the first half wave and the second half wave and the start phase angle applied to the third half wave and the fourth half wave is changed for each control period, thereby reducing the harmonic current due to the third factor. In this example, each time the control period changes, the supply rate applied in the first half of the control period gradually decreases, and the supply rate applied in the first half of the control period gradually increases. Additionally, the minimum value of the supply rate is assumed to be 5%, and the maximum value of the supply rate is assumed to be 95%. In this example, in a case where the supply rate applied to the first half of a control period reaches 5% and the supply rate applied to the second half of the control period reaches 95%, the supply rate of the first half of the next control period is increased and the supply rate of the second half of the next control period is decreased. Finally, in a case where the first half supply rate becomes 95% and the second half supply rate becomes 5%, the first half supply rate shifts from increase to decrease and the second half supply rate shifts from decrease to increase. Here, the rate of change of the supply rate for each control period is set to 5%, but this is merely an example. This rate of change may be, for example, 1%.

If the supply rate per one control period is 40%, the combination of the first half supply rate and the second half supply rate changes, for example, from 20% and 60%, to 15% and 65%, and then to 10% and 70%. Incidentally, in a case where the prohibited region is set to a range of 70° to 110° for one half wave (range of 0° to 180°), the supply rate becomes approximately 38 to 62%.

In this manner, in a case where the same supply rate is decided over a plurality of control periods, the controller 15 decides the start phase angle such that the start phase angle corresponding to the supply rate is located outside the prohibited sections X and a combination of start phase angles differs for each control period. Further, the controller 15 may change the prohibited sections X for each control period to thereby reduce harmonic currents associated with the third factor. For example, a prohibited section X1 for a first control period and a prohibited section X2 for a second control period are different. Similarly, the prohibited section X2 for the second control period and a prohibited section X3 for a third control period are different. Note that the prohibited section X for the first heater 24A and the prohibited section X for the second heater 24B may coincide with each other or may be different from each other.

<Controller>

Figure 5:
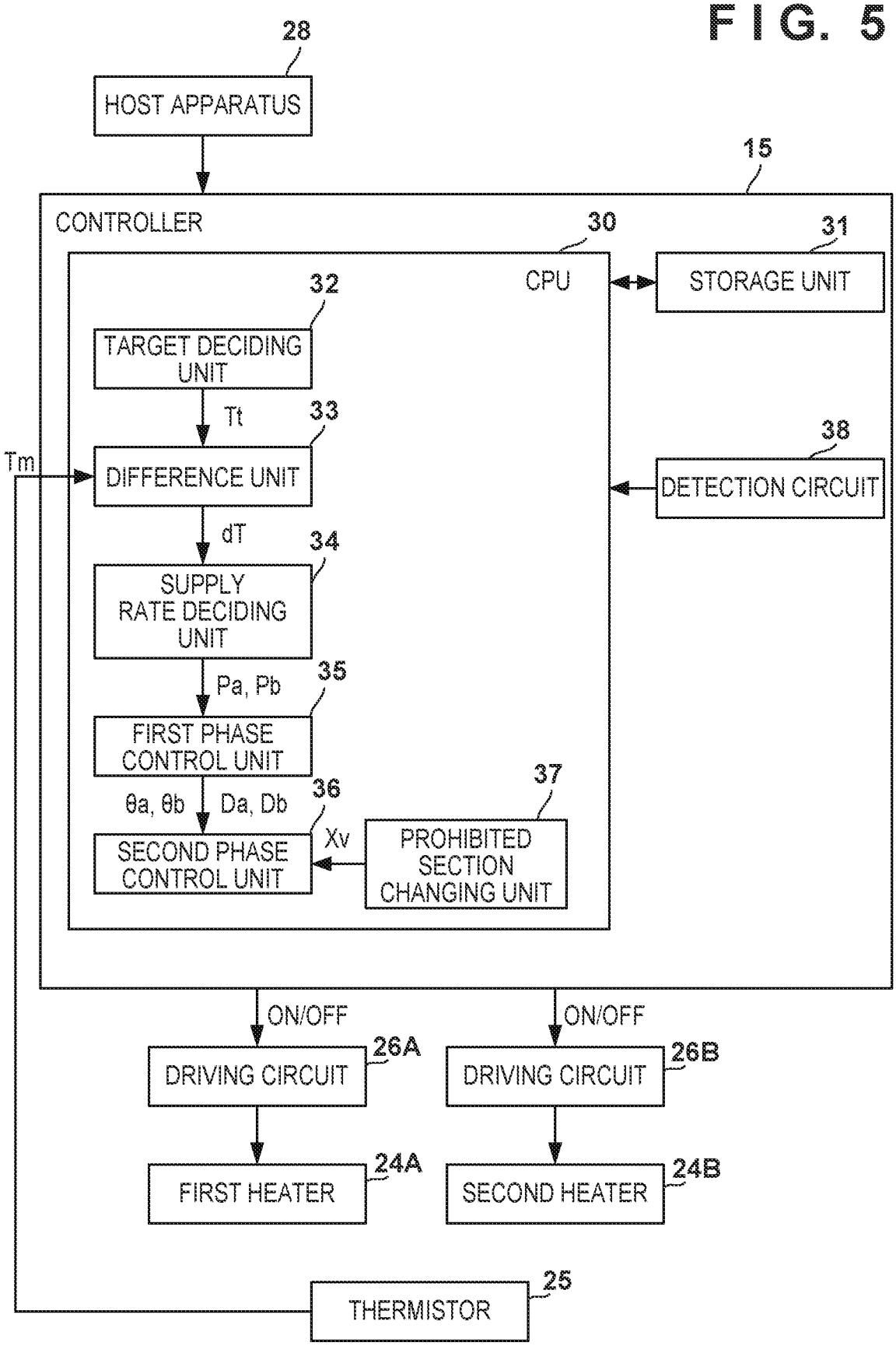
FIG. 5 is a block diagram for describing a controller.

FIG. 5 is a view for describing functions of the controller 15. The CPU 30 realizes various functions by executing programs stored in a ROM region of a storage unit 31. Note that part or all of these functions may be realized by hardware such as an ASIC or an FPGA. ASIC is an abbreviation for Application Specific Integrated Circuit. FPGA is an abbreviation for Field Programmable Gate Array. A host apparatus 28 is a computer, an image scanner, a digital camera, or the like that transmits sheet information to the image forming apparatus 1. A target deciding unit 32 decides a target temperature Tt of the fixing device 12 based on the sheet information. For example, the target deciding unit 32 decides the target temperature Tt to be relatively high for a sheet S having a large basis weight, and decides the target temperature Tt to be relatively low for a sheet S having a low basis weight. A difference unit 33 acquires a difference dT between a target temperature Tt and a measured temperature Tm obtained by the thermistor 25. The supply rate deciding unit 34 decides a supply rate P corresponding to the difference dT. For example, the supply rate deciding unit 34 decides a supply rate Pa of the first heater 24A and a supply rate Pb of the second heater 24B. A table or a function (formula) for deciding the supply rates Pa and Pb may be stored in the storage unit 31 in advance. A first phase control unit 35 decides the start phase angle θa of the first heater 24A based on the supply rate Pa, and decides the start phase angle θb of the second heater 24B based on the supply rate Pb. A table or a function (formula) for deciding the start phase angle θa from the supply rate Pa may be prepared in advance and stored in the storage unit 31. Similarly, a table or a function (formula) for deciding the start phase angle θb from the supply rate Pb may be stored in advance in the storage unit 31. Further, the first phase control unit 35 decides the shift amount Da of the first heater 24A and the shift amount Db of the second heater 24B. A prohibited section changing unit 37 changes the prohibited section Xv for each control period, and outputs it to the second phase control unit 36. The second phase control unit 36 decides the corrected start phase angles θa', θb' based on the start phase angles θa, θb and the prohibited section Xv. In other words, the shift amounts Da and Db are decided such that the start phase angles θa' and θb' are located outside the prohibited section Xv. Further, if the start phase angles θa' and θb' do not coincide with each other, an effect of reducing harmonic currents is further enhanced. The second phase control unit 36 turns on the driving circuit 26A at the start phase angle θa' to supply an alternating current to the first heater 24A, and turns off the driving circuit 26A at the zero cross point T0. The second phase control unit 36 turns on the driving circuit 26A at the start phase angle θb' to supply an alternating current to the second heater 24A, and turns off the driving circuit 26A at the zero cross point T0. The detection circuit 38 detects the alternating current zero cross point T0 and notifies the CPU 30 of the zero cross point T0. The CPU 30 recognizes the phase angle of the alternating current based on the zero cross point T0 detected by the detection circuit 38. In addition, the CPU 30 may calculate the length of the half period of the alternating current by measuring the times of two adjacent zero cross points T0.

<Flow Chart>

Figure 6:
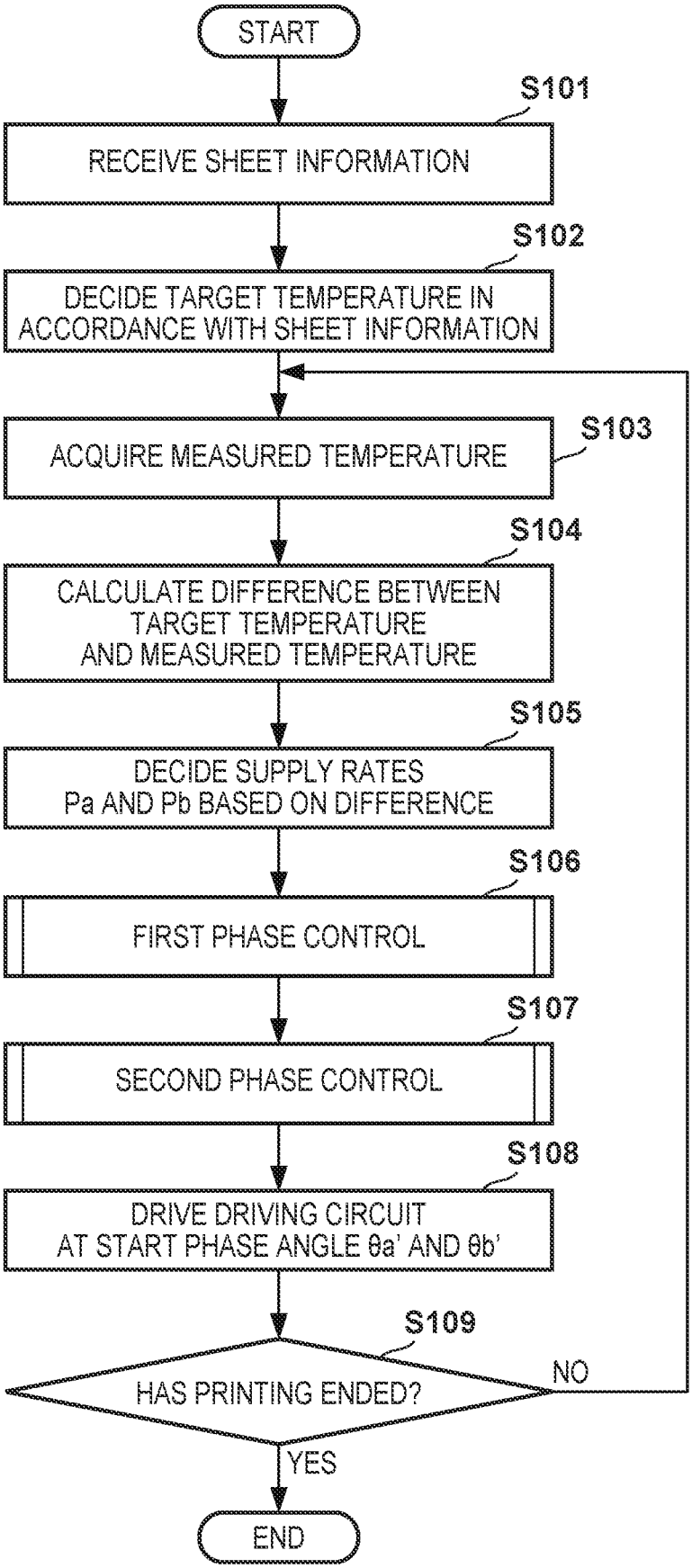
FIG. 6 is a flow chart illustrating main phase control.

FIG. 6 is a flow chart illustrating main phase control.

In step S101, the CPU 30 (as target deciding unit 32) receives sheet information from the host apparatus 28.

In step S102, the CPU 30 (as target deciding unit 32) decides the target temperatures Tt corresponding to the sheet information.

In step S103, the CPU 30 acquires the measured temperature Tm from the thermistor 25.

In step S104, the CPU 30 (as difference unit 33) calculates the difference dT between the target temperature Tt and the measured temperature Tm.

In step S105, the CPU 30 (as supply rate deciding unit 34) decides the supply rates Pa and Pb such that the difference dT becomes small.

In step S106, the CPU 30 (as first phase control unit 35) performs the first phase control based on the supply rates Pa and Pb, and decides the start phase angles θa and θb and the shift amounts Da and Db. The first phase control unit 35 executes the first phase control based on the supply rate Pa, and decides the start phase angle θa and the shift amount Da. The first phase control unit 35 executes the first phase control based on the supply rate Pb, and decides the start phase angle θb and the shift amount Db. Note that the first phase control unit 35 may decide a minimum value Damin and a maximum value Damax that can be taken by the shift amount Da. The first phase control unit 35 may decide a minimum value Dbmin and a maximum value Dbmax that can be taken by the shift amount Db. In other words, the first phase control unit 35 may select, as the shift amount Da, an arbitrary shift amount that is greater than or equal to the minimum value Damin and less than or equal to the maximum value Damax, or may output both the minimum value Damin and the maximum value Damax. Here, it is assumed that the first phase control unit 35 outputs the minimum value Damin and the maximum value Damax to the second phase control unit 36, and the second phase control unit 36 decides the final shift amount Da. Similarly, the first phase control unit 35 may select, as the shift amount Db, an arbitrary shift amount that is greater than or equal to the minimum value Dbmin and less than or equal to the maximum value Dbmax, or may output both the minimum value Dbmin and the maximum value Dbmax. Here, it is assumed that the first phase control unit 35 outputs the minimum value Dbmin and the maximum value Dbmax to the second phase control unit 36, and the second phase control unit 36 decides the final shift amount Db.

In step S107, the CPU 30 (as prohibited section changing unit 37, second phase control unit 36) changes the prohibited section Xv for each control period, and decides the corrected start phase angles θa', θb' based on the prohibited section Xv, the start phase angles θa, θb, and the shift amounts Da, Db.

In step S108, the CPU 30 (as second phase control unit 36) drives the driving circuit 26A based on the corrected start phase angle θa' and drives the driving circuit 26B based on the corrected start phase angle θb'.

In step S109, the CPU 30 determines whether or not printing has ended. If printing has not ended, the CPU 30 advances the process to step S103 and repeats execution of step S103 to step S109.

•First Phase Control

Figure 7:
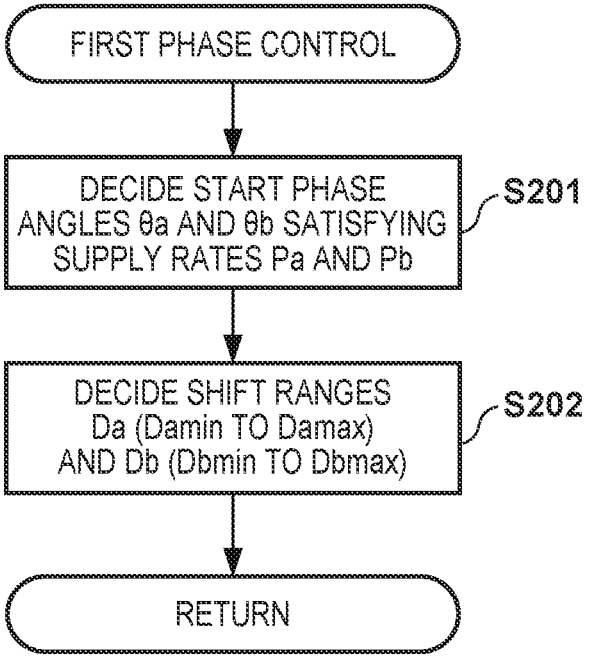
FIG. 7 is a flow chart illustrating first phase control.

FIG. 7 is a flow chart illustrating details of the first phase control in step S106.

In step S201, the CPU 30 (as first phase control unit 35) decides a start phase angle θa that meets the supply rate Pa in one half wave and decides a start phase angle θb that meets the supply rate Pb in one half wave.

In step S202, the CPU 30 (as first phase control unit 35) decides a shift range (Damin to Damax) which is a range that the shift amount Da can take, and a shift range (Dbmin to Dbmax) of the shift amount Db. For example, Damin may be −Da, and Damax may be +Da, as FIG. 3A illustrates. Dbmin may be −Db, and Dbmax may be +Db, as FIG. 3B illustrates.

•Second Phase Control

In the present embodiment, two constraints may be employed to reduce harmonic current. The first constraint is that the start phase angle θ' acquired by correcting the start phase angle θ by the shift amount D, and the start phase angle θ exist in the same half wave. The second constraint is that the start phase angle θ' is not included in the prohibited section X. The CPU 30 decides the shift range (Damin to Damax) so that these two constraints are met.

For example, Dmax may be decided as follows.

| | |
|---|---|
| $0 \le P \le x/2$ | $Dmax = p$ |
| $x/2 \le P \le (1 - x)/2$ | $Dmax = -p + X$ |
| $(1 - x)/2 \le P \le 0.5$ | $Dmax = p$ |
| $0.5 \le P \le (1 + x)/2$ | $Dmax = -p + 1$ |
| $(1 + X)/2 \le P \le 1 - x/2$ | $Dmax = p - (1 - X)$ |
| $1 - x/2 \le P \le 1$ | $Dmax = -p + 1$ |

For example, Dmin may be decided as follows.

| | |
|---|---|
| $P < 0.5$ | $Dmin = -p + (1 - X)$ |
| $0.5 \le P$ | $Dmin = p - X$ |

Where p is the phase angle (p=P×180 degrees) corresponding to the supply rate P. x is the supply rate (x=X/180) corresponding to the prohibited section X.

The CPU 30 decides a final shift amount D from the shift range (Damin to Damax) based on the start phase angles θ of the plurality of heaters. The controller 15 decides the shift amounts Da and Db so that the start phase angle θa' of the first heater 24A and the start phase angle θb' of the second heater 24B in the same half wave are sufficiently separated from each other. For example, as illustrated in FIGS. 3A and 3B, the sign of the shift amount Da and the sign of the shift amount Db in the same half wave may be reversed.

Figure 8:
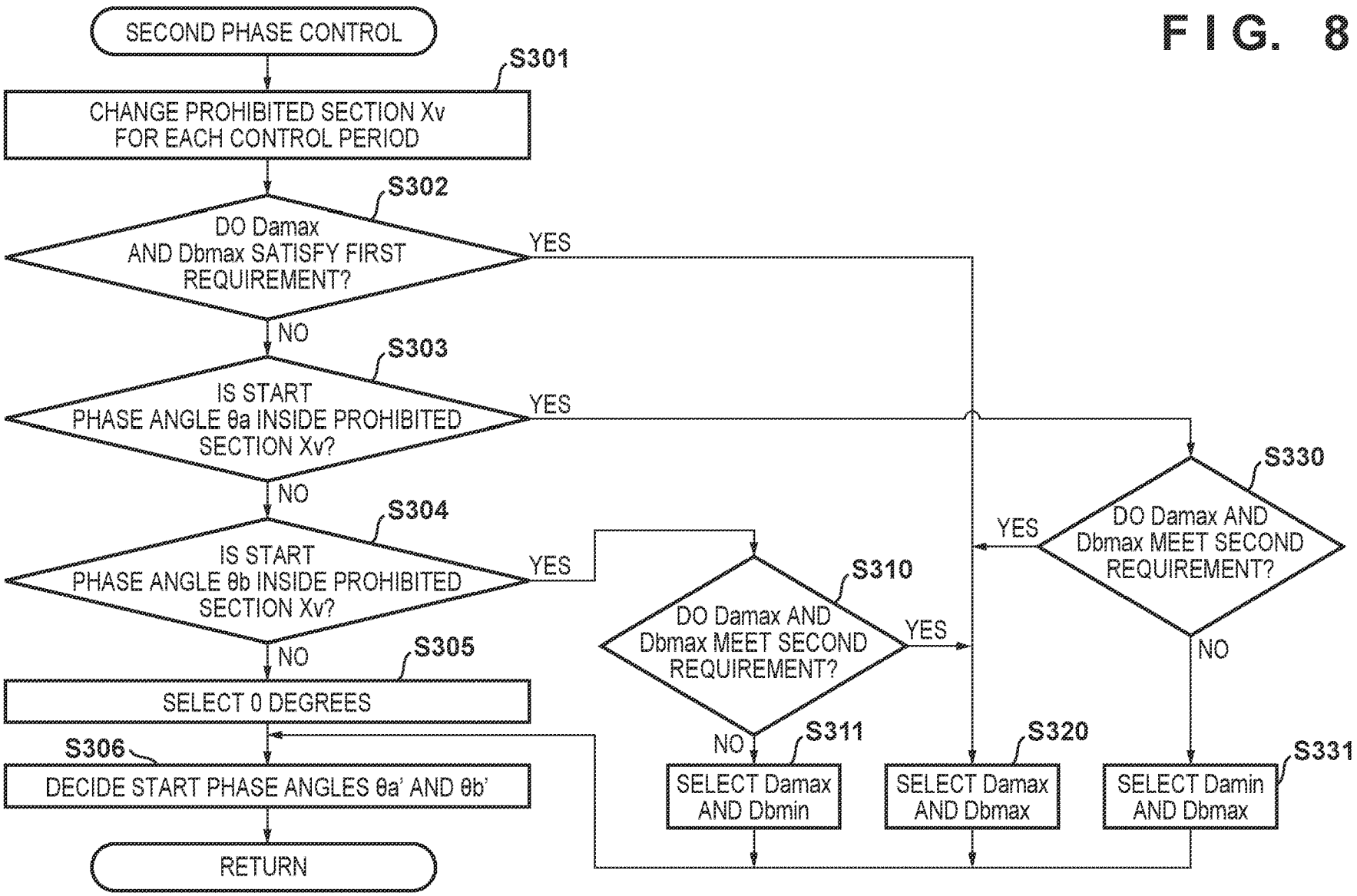
FIG. 8 is a flow chart illustrating second phase control.

FIG. 8 is a flow chart illustrating details of the second phase control in step S107. It is sufficient if the start phase angle is located outside the prohibited section Xv and is different for each control period. For example, the prohibited section Xv may be fixed, and the shift amount of the start phase angle may be changed each control period. As another method, a method of changing the prohibited section Xv for each control period can be considered. However, since it is sufficient to decide the combination of the start phase angles so as to be located outside the prohibited section Xv and different for each control period, still other decision methods may be adopted.

In step S301, the CPU 30 (as prohibited section changing unit 37) changes the prohibited section Xv for each control period. Thereby, harmonic currents are reduced compared to the prior art. For example, the prohibited section changing unit 37 changes the prohibited section Xv within a variable range of the prohibited section that is determined in advance. The storage unit 31 may store a plurality of prohibited sections Xv. In this case, the prohibited section changing unit 37 may randomly select one prohibited section Xv from a plurality of prohibited sections Xv. Alternatively, the plurality of prohibited sections Xv may be assigned a respective order. In this case, the prohibited section changing unit 37 may select, in accordance with an order, one prohibited section Xv from a plurality of prohibited sections Xv. The prohibited section Xv may be decided such that the center phase angle of the half wave W (90 degrees+n×180 degrees) is the center. Alternatively, the center of the prohibited section Xv may be shifted from the center phase angle of the half wave W. However, even in this case, it is assumed that the prohibited section Xv includes the center phase angle of a half wave W.

In step S302, the CPU 30 (as second phase control unit 36) determines whether or not Damax and Dbmax meet a first requirement. As illustrated in FIG. 3A, the second phase control unit 36 obtains θa' using Damax (half waves W1, W2: θa'=θa+Damax; half waves W3, W4: θa'=θa−Damax). As illustrated in FIG. 3B, the second phase control unit 36 obtains θb' using Dbmax (half waves W1, W2: θb'=θb−Dbmax; half waves W3, W4: θb'=θb+Dbmax). Here, the first requirement is that the distance |θa'−θb'| exceeds the distance |θa−θb| in all of the four half waves. In other words, if the distance between the start phase angle of the first heater 24A and the start phase angle of the second heater 24B is increased by the shift (correction) of the start phase angle, the harmonic current is reduced. If the first requirement is met, the CPU 30 advances the processing to step S320. In step S320, the CPU 30 (as second phase control unit 36) selects Damax as the shift amount Da, selects Dbmax as the shift amount Db, and advances the processing to step S306. Meanwhile, if the first requirement is not met, the CPU 30 advances the processing to step S303.

In step S303, the CPU 30 (as second phase control unit 36) determines whether or not the start phase angle θa is inside the prohibited section Xv. The start phase angle θa being inside the prohibited section Xv means that the start phase angle θa is included in the prohibited section Xv. If the start phase angle θa is inside the prohibited section Xv, the CPU 30 advances the processing to step S330. In step S330, the CPU 30 (as second phase control unit 36) determines whether or not Damax and Dbmax meet a second requirement. As illustrated in FIG. 3A, the second phase control unit 36 obtains θa' using Damax (half waves W1, W2: θa'=θa+Damax; half waves W3, W4: θa'=θa−Damax). As illustrated in FIG. 3B, the second phase control unit 36 obtains θb' using Dbmax (half waves W1, W2: θb'=θb−Dbmax; half waves W3, W4: θb'=θb+Dbmax). Here, the second requirement is that the distance between the start phase angle θa' and the start phase angle θb' exceeds a threshold value θth in all four half waves. If the second requirement is met, the CPU 30 advances the processing to step S320. In other words, Damax is selected as the shift amount Da, and Dbmax is selected as the shift amount Db. If the second requirement is not met, the CPU 30 advances the processing to step S331. In step S331, the CPU 30 (as second phase control unit 36) selects Damin as the shift amount Da, selects Dbmax as the shift amount Db, and advances the processing to step S306. Meanwhile, if the start phase angle θa is not inside the prohibited section Xv, the CPU 30 advances the processing to step S304.

In step S304, the CPU 30 (as second phase control unit 36) determines whether or not the start phase angle θb is inside the prohibited section Xv. The start phase angle θb being inside the prohibited section Xv means that the start phase angle θb is included in the prohibited section Xv. If the start phase angle θb is inside the prohibited section Xv, the CPU 30 advances the processing to step S310. In step S310, the CPU 30 (as second phase control unit 36) determines whether or not Damax and Dbmax meet the second requirement. This determination process is similar to step S330. If the second requirement is met, the CPU 30 advances the processing to step S320. In other words, Damax is selected as the shift amount Da, and Dbmax is selected as the shift amount Db. If the second requirement is not met, the CPU 30 advances the processing to step S311. In step S311, the CPU 30 (as second phase control unit 36) selects Damax as the shift amount Da, selects Dbmin as the shift amount Db, and advances the processing to step S306. Meanwhile, if the start phase angle θb is not inside the prohibited section Xv, the CPU 30 advances the processing to step S305.

In step S305, the CPU 30 (as second phase control unit 36) selects 0 degrees as the shift amount Da, selects 0 degrees as the shift amount Db, and advances the processing to step S306. This means that the start phase angle is not substantially corrected (shifted).

In step S306, the CPU 30 (as second phase control unit 36) decides the start phase angle θa' using the shift amount Da selected in step S305, S311, S320 or S331. Furthermore, the CPU 30 (as second phase control unit 36) decides the start phase angle θb' using the shift amount Db selected in step S305, S311, S320 or S331.

In this manner, the controller 15 decides the start phase angles θa' and θb' while changing the prohibited section Xv for each control period. Thereby, harmonic currents are reduced.

<Summary>

As illustrated in FIG. 1, the ceramic heater 23 is an example of a heating unit. The fixing device 12 is an example of a fixing unit that fixes a toner image to a sheet S by applying heat in accordance with the heating unit. The thermistor 25 is an example of an acquisition unit (a temperature detector) for acquiring a measured temperature of the heating unit. The controller 15 is an example of a control unit for controlling the supply of an alternating current to the heating unit. As illustrated in step S105, the controller 15 decides the supply rate for each control period, which comprises a plurality of half periods, of the alternating current based on the difference between the target temperature and the measured temperature of the heating unit. As indicated in steps S106 and S201, the controller 15 decides start phase angles which are references of the start of supply corresponding to a supply rate. The same supply rate may be decided over a plurality of control periods. For example, the controller 15 decides that the start phase angles, which are references for the start of supply corresponding to the supply rate, is located outside the prohibited section, and a combination of start phase angles differs for each control period. As illustrated in FIGS. 4A to 4C, the combination of start phase angles is a combination of the start phase angle applied to the first half of the control period (first half wave and second half wave) and the start phase angle applied to the second half of the control period (third half wave and fourth half wave). As step S108 illustrates, for each of the plurality of half periods that configure the control period, the controller 15 starts supply of current to the heating unit at a start phase angle. Further, the controller 15 is configured to stop the power supply to the heating unit when the zero cross point of the alternating current arrives. Note that, the controller 15 may have a detection circuit for detecting the zero cross point of the alternating current. Although the harmonic current can be reduced by providing a wide fixed prohibited section, the temperature followability is lowered. In a case where a fixed prohibited section having a narrow width is provided, the temperature followability is improved, but the effect of reducing the harmonic current is reduced. On the other hand, since the controller 15 of the present embodiment changes the combination of start phase angles for each control period, it becomes possible to achieve both temperature followability and a reduction of harmonic currents.

For example, as indicated in step S301, the controller 15 decides a prohibited section that is changed each control period and is applied to each of a plurality of half periods in the alternating current that configures the control period. As indicated in steps S305, S311, S320, and S311 the predetermined shift amount is decided so that the start phase angle corrected by the predetermined shift amount is located outside of the prohibited section. As step S306 illustrates, for each of the plurality of half periods that configure the control period, the controller 15 corrects the start phase angle by a predetermined shift amount. As step S108 illustrates, for each of the plurality of half periods that configure the control period, the controller 15 starts supply of the alternating current to the heating unit at the start phase angle which has been corrected by the predetermined shift amount. As described above, the controller 15 according to the present embodiment may change the prohibited section Xv for each control period to achieve both temperature followability and a reduction of harmonic currents.

Several methods for making the prohibited section variable may be considered. For example, the controller 15 may change the prohibited section for each control period within a predetermined range. In addition, the storage unit 31 may be used as a storage unit that stores a plurality of prohibited sections. In this case, the controller 15 selects one prohibited section from a plurality of prohibited sections stored in the storage unit for each control period. As a result, the prohibited section may be changed each control period. In this case, the controller 15 may select one prohibited section from a plurality of prohibited sections according to a predetermined selection rule. As the selection rule, for example, a rule for randomly selecting one prohibited section from a plurality of prohibited sections may be employed. Further, the prohibited section may be changed by adding or subtracting a triangular wave to or from a basic prohibited section.

The heating unit may include the first heater 24A and the second heater 24B. The controller 15 decides a first supply rate (for example: Pa) which is a supply rate for the first heater 24A and a second supply rate (for example: Pb) which is a supply rate for the second heater 24B. The controller 15 decides a first phase angle (for example: θa), which is a start phase angle corresponding to the first supply rate, and a second phase angle (for example: θb), which is a start phase angle corresponding to the second supply rate. The controller 15 decides a first shift amount (for example: Da) which is a shift amount for the first heater, and a second shift amount (for example: Db) which is a shift amount for the second heater. The controller 15 corrects the first phase angle by the first shift amount, and corrects the second phase angle by the second shift amount. The controller 15 starts supply of the alternating current to the first heater at the first phase angle corrected by the first shift amount for each of the plurality of half periods configuring the control period, and stops supply of the alternating current to the first heater when a zero cross point of the alternating current arrives. The controller 15 starts supply of the alternating current to the second heater at the second phase angle corrected by the second shift amount, and stops supply of the alternating current to the second heater when a zero cross point of the alternating current arrives.

The controller 15 obtains the distance |θa−θb| between the first phase angle θa and the second phase angle θb, and the distance |θa'−θb'| between the first phase angle θa−Da where correction is by the first shift amount Da and the second phase angle θb−Db where correction is by the second shift amount Db. The controller 15 may decide the first shift amount Da and the second shift amount Db so that the distance |θa'−θb'| becomes larger than the distance |θa−θb|. Thus, the peak of the harmonic current in the total of the first heater 24A and the second heater 24B is reduced.

There may be a case where there is no first shift amount and the second shift amount such that the distance |θa'−θb'| becomes larger than the distance |θa−θb|. In this case, the controller 15 may decide the first shift amount and the second shift amount such that the distance between the first phase angle corrected by the first shift amount and the second phase angle corrected by the second shift amount is larger than a predetermined threshold value.

The controller 15 may select the first shift amount Da from between the first minimum shift amount (e.g.: Damin) and the first maximum shift amount (e.g.: Damax). The controller 15 may select the second shift amount Db from between the second minimum shift amount (e.g.: Dbmin) and the second maximum shift amount (e.g.: Dbmax).

The controller 15 may determine whether or not the first requirement is met. The first requirement is a requirement that the distance between the first phase angle (θa−Damax) corrected by the first maximum shift amount and the second phase angle (θb−Dbmax) corrected by the second maximum shift amount is larger than the distance between the first phase angle and the second phase angle. If the first requirement is met, the controller 15 may select the first maximum shift amount as the first shift amount and select the second maximum shift amount as the second shift amount.

If the first requirement is not met, controller 15 may determine whether or not the first phase angle is inside the prohibited section. If the first phase angle is inside the prohibited section, the controller 15 may determine whether or not the second requirement is met. The second requirement is that the distance between the first phase angle corrected by the first maximum shift amount and the second phase angle corrected by the second maximum shift amount is larger than a predetermined threshold value. If the second requirement is met, the controller 15 may select the first maximum shift amount as the first shift amount and select the second maximum shift amount as the second shift amount.

If the second requirement is not met, the controller 15 may select the first minimum shift amount as the first shift amount and select the second maximum shift amount as the second shift amount.

If the first phase angle is not inside the prohibited section, the controller 15 may determine whether or not the second phase angle is inside the prohibited section. The controller 15 may select 0 as the first shift amount and select 0 as the second shift amount in a case where the second phase angle is inside the prohibited section.

The controller 15 may determine whether or not the second requirement is met if the second phase angle is not inside the prohibited section. If the second requirement is met, the controller 15 may select the first maximum shift amount as the first shift amount and select the second maximum shift amount as the second shift amount.

If the second phase angle is not inside the prohibited section and the second requirement is not met, the controller 15 may select the first maximum shift amount as the first shift amount and select the second minimum shift amount as the second shift amount.

In a case where any element in the claims is given a reference sign, the reference sign merely indicates an example of the element in the specification and the drawings. Therefore, reference signs should not be used as a basis for a limiting interpretation.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-007173, filed Jan. 18, 2019 which is hereby incorporated by reference herein in its entirety.

What is claimed is:

1. An image forming apparatus comprising:

a fixing unit that has a heater and is configured to fix a toner image to a sheet by applying heat from the heater;

a temperature detector configured to detect a temperature of the fixing unit; and a controller configured to control a supply of alternating current to the heater, wherein the controller is configured to:

based on a difference between a target temperature of the fixing unit and the temperature detected by the temperature detector, decide a supply rate for each control period that comprises a plurality of half periods in the alternating current, in a case where the same supply rate over a plurality of the control period is decided, decide a start phase angle that is a reference for a supply start corresponding to the supply rate so that the start phase angle is located outside a prohibited section and a combination of the start phase angle differs for each control period, and for each of a plurality of half periods configuring the control period, start supply of the alternating current to the heater at the start phase angle, and stop supply of the alternating current to the heater when a zero cross point of the alternating current arrives.

2. The image forming apparatus according to claim 1, wherein the controller is configured to:

decide the prohibited section to be applied to each of a plurality of half periods of the alternating current configuring the control period so that the prohibited section changes for each control period, decide a predetermined shift amount so that the start phase angle corrected by the predetermined shift amount is located outside the prohibited section, correct the start phase angle by the predetermined shift amount for each of the plurality of half periods configuring the control period, for each of the plurality of half periods configuring the control period, start supply of the alternating current to the heater at the start phase angle corrected by the predetermined shift amount, and stop supply of the alternating current to the heater when a zero cross point of the alternating current arrives.

3. The image forming apparatus according to claim 2, wherein for each control period, the controller changes the prohibited section within a predetermined range.

4. The image forming apparatus according to claim 2, further comprising:

a memory configured to store a plurality of prohibited sections, wherein the controller is configured to change the prohibited section for each control period by selecting one prohibited section from the plurality of prohibited sections stored in the memory each control period.

5. The image forming apparatus according to claim 4, wherein the controller is configured to select one prohibited section from the plurality of prohibited sections according to a predetermined selection rule.

6. The image forming apparatus according to claim 5, wherein the controller is configured to select one prohibited section from the plurality of prohibited sections at random.

7. The image forming apparatus according to claim 2, wherein the heater has a first heater and a second heater, and the controller is configured to:

decide a first supply rate that is the supply rate for the first heater and a second supply rate that is the supply rate for the second heater, decide a first phase angle that is the start phase angle corresponding to the first supply rate, and a second phase angle that is the start phase angle corresponding to the second supply rate, decide a first shift amount that is the shift amount for the first heater and a second shift amount that is the shift amount for the second heater, correct the first phase angle by the first shift amount, and correct the second phase angle by the second shift amount, and for each of the plurality of half periods configuring the control period, start supply of the alternating current to the first heater at the first phase angle corrected by the first shift amount, stop supply of the alternating current to the first heater when a zero cross point of the alternating current arrives, start supply of the alternating current to the second heater at the second phase angle corrected by the second shift amount, and stop supply of the alternating current to the second heater when a zero cross point of the alternating current arrives.

8. The image forming apparatus according to claim 7, wherein the controller is configured to decide the first shift amount and the second shift amount such that a distance between the first phase angle corrected by the first shift amount and the second phase angle corrected by the second shift amount is larger than a distance between the first phase angle and the second phase angle.

9. The image forming apparatus according to claim 8, wherein the controller is configured to, if the first shift amount and the second shift amount do not meet that a distance between the first phase angle corrected by the first shift amount and the second phase angle corrected by the second shift amount is larger than a distance between the first phase angle and the second phase angle, decide the first shift amount and the second shift amount so that the distance between the first phase angle corrected by the first shift amount and the second phase angle corrected by the second shift amount is larger than a predetermined threshold value.

10. The image forming apparatus according to claim 9, wherein the controller is configured to select the first shift amount from among the first minimum shift amount and the first maximum shift amount, and to select the second shift amount from among the second minimum shift amount and the second maximum shift amount.

11. The image forming apparatus according to claim 10, wherein the controller is configured to determine whether or not a first requirement of a distance between the first phase angle corrected by the first maximum shift amount and the second phase angle corrected by the second maximum shift amount being larger than a distance between the first phase angle and the second phase angle is met, and if the first requirement is met, select the first maximum shift amount as the first shift amount, and select the second maximum shift amount as the second shift amount.

12. The image forming apparatus according to claim 11, wherein the controller is configured to if the first requirement is not met, determine whether or not the first phase angle is inside the prohibited section, and if the first phase angle is inside the prohibited section, determine whether or not a second requirement of a distance between the first phase angle corrected by the first maximum shift amount and the second phase angle corrected by the second maximum shift amount being larger than the predetermined threshold value is met, and if the second requirement is met, select the first maximum shift amount as the first shift amount, and select the second maximum shift amount as the second shift amount.

13. The image forming apparatus according to claim 12, wherein the controller is configured to if the second requirement is not met, select the first minimum shift amount as the first shift amount, and select the second maximum shift amount as the second shift amount.

14. The image forming apparatus according to claim 13, wherein the controller is configured to if the first phase angle is not inside the prohibited section, determine whether or not or the second phase angle is inside the prohibited section, and if the second phase angle is inside the prohibited section, select 0 as the first shift amount, and select 0 as the second shift amount.

15. The image forming apparatus according to claim 14, wherein the controller is configured to if the second phase angle is not inside the prohibited section, determine whether or not the second requirement is met, and if the second requirement is met, select the first maximum shift amount as the first shift amount, and select the second maximum shift amount as the second shift amount.

16. The image forming apparatus according to claim 15, wherein the controller is configured to in a case where the second phase angle is not inside the prohibited section and the second requirement is not met, select the first maximum shift amount as the first shift amount, and select the second minimum shift amount as the second shift amount.

17. The image forming apparatus according to claim 14, wherein the prohibited section includes a phase angle at which the amplitude of the alternating current is a maximum.

18. A method for controlling an image forming apparatus, the method comprising:

based on a difference between a target temperature of a heater provided in a fixing device and a measured temperature, deciding a supply rate for each control period that comprises a plurality of half periods in the alternating current;

deciding a start phase angle that is a reference for a start of supply corresponding to the supply rate;

in a case where the same supply rate over a plurality of the control period is decided, deciding a start phase angle that is a reference for a supply start corresponding to the supply rate so that the start phase angle is located outside a prohibited section and a combination of the start phase angle differs for each control period; and for each of a plurality of half periods configuring the control period, starting supply of the alternating current to the heater at the start phase angle, and stopping supply of the alternating current to the heater when a zero cross point of the alternating current arrives.

* * * * *